US006769566B1

(12) United States Patent
Rubin et al.

(10) Patent No.: US 6,769,566 B1
(45) Date of Patent: Aug. 3, 2004

(54) DIAPER DISPENSING DEVICE AND METHOD

(76) Inventors: Lori A. Rubin, 53 Old Howarth Rd., Oxford, MA (US) 01540; Thomas J. Broeski, 32 Mount View Dr., Afton, VA (US) 22920

( * ) Notice: Subject to any disclaimer, the term of this patent is extended or adjusted under 35 U.S.C. 154(b) by 119 days.

(21) Appl. No.: 10/246,031

(22) Filed: Sep. 18, 2002

(51) Int. Cl.[7] ..... B65H 1/08; B65H 1/00; B65H 1/30

(52) U.S. Cl. ..... 221/56

(58) Field of Search ..... 221/56, 59, 61, 221/279, 281, 303; B65H 1/08, 1/00, 1/30; B65G 1/08; G07F 11/16; A47F 1/04

(56) References Cited

U.S. PATENT DOCUMENTS 2,153,113 A * 4/1939 Winter ..... 221/38
3,953,090 A * 4/1976 Fuchs ..... 312/183
3,957,175 A * 5/1976 Gordon ..... 221/215
4,311,252 A * 1/1982 Hope et al. ..... 221/57
5,255,817 A * 10/1993 Reiland et al. ..... 221/1

* cited by examiner

*Primary Examiner*—Donald P. Walsh
*Assistant Examiner*—Kenneth W Bower
(74) *Attorney, Agent, or Firm*—Law Office of Marc D. Machtinger, Ltd.

(57) ABSTRACT

A diaper storage and dispensing device and method is disclosed including a housing having an interior within which a stack of diapers is stored. The diapers are preferably stacked on top of a movable platform. The housing includes an access aperture through which the device can be stocked with diapers. The movable platform is preferably under tension in order to press the diapers upward. A dispensing opening is located toward the top of the device. The top diaper is aligned with the dispensing opening, and a diaper displacement mechanism operates to advance a single diaper at least partially out through the dispensing opening. The displacement mechanism is operated by a user pressing on a lever such as a foot pedal. After the diaper is removed, the next diaper in the stack is aligned with the displacement mechanism and the dispensing opening.

20 Claims, 3 Drawing Sheets

DIAPER DISPENSING DEVICE AND METHOD

TECHNICAL FIELD

The present invention relates to diaper dispensing devices, and more specifically to a diaper storage and dispensing device for selectively dispensing individual diapers, and a method for making the same.

BACKGROUND OF THE INVENTION

Infants and toddlers must be diapered multiple times a day. Due to the numerous burdens on the caretaker of children, it is important to provide diapers in the most convenient manner available.

Various prior art devices exist to store diapers. However, such devices do not provide sufficient convenience to the user.

For example, U.S. Pat. No. 5,678,727 issued to Rice discloses a diaper dispenser apparatus. The Rice apparatus provides a storage means for diapers, and an opening for manually pulling diapers out of the device. Such a device is insufficient because manually separating and pulling the diaper out of the device is a cumbersome task.

Other prior art devices fail to adequately address these concerns. Therefore, it would b e advantageous to provide a diaper storage and dispensing device which provides an easier means for the user to access and remove a diaper when needed.

SUMMARY

In view of the deficiencies described above, it is an object of the present invention to provide a diaper storage and dispensing device which will conveniently dispense diapers upon the need of the user.

In accordance with the above objectives, the present invention is a diaper storage and dispensing device. The device includes a housing which stands substantially vertically. The housing has an interior within which a stack of diapers is stored. The diapers are preferably stacked on top of a movable platform. The housing includes an access aperture through which the device can be stocked with diapers.

The movable platform is preferably under tension in order to press the diapers upward. A dispensing opening is located toward the top of the device. The top diaper is aligned with the dispensing opening, and a diaper displacement mechanism operates to advance a single diaper at least partially out through the dispensing opening.

The displacement mechanism is operated by a user pressing on a lever such as a foot pedal. After the diaper is removed, the next diaper in the stack is aligned with the displacement mechanism and the dispensing opening.

A method for manufacturing the device of the present invention by providing the various components described in detail below is also disclosed.

Other features and advantages of the invention will be apparent from the following detailed description taken in conjunction with the following drawings.

DETAILED DESCRIPTION

Figure 1:
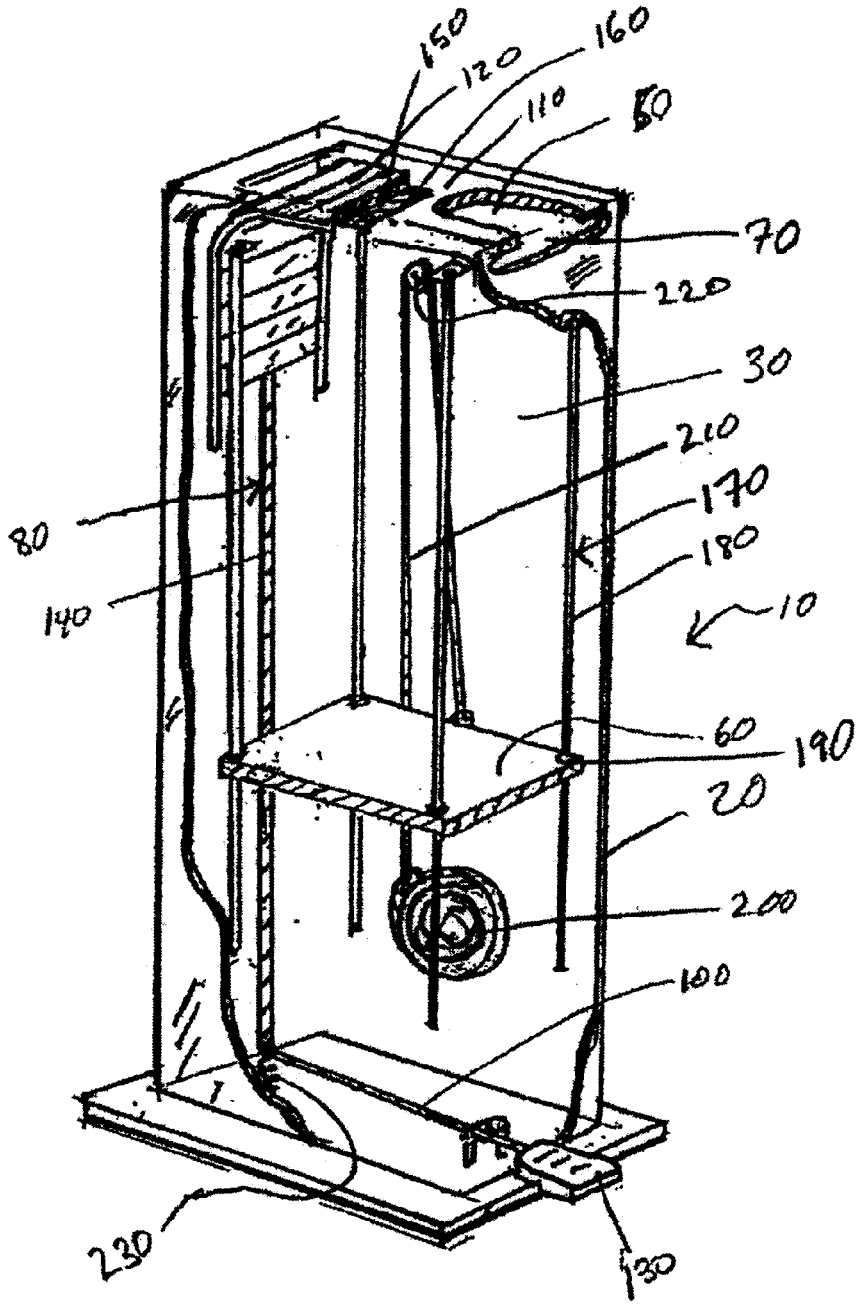
FIG. 1 is a perspective cut away view of one embodiment of the device of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

In a preferred embodiment, the device of the present invention is a diaper storage and dispensing device 10. The device comprises a housing 20 having an interior cavity 30 for storing a stacked plurality of diapers 40.

The housing 20 includes an access aperture 50 within the housing 20 for accessing and stocking the interior cavity 30 of the housing 20 with the plurality of diapers 40.

The device 10 includes a substantially horizontal movable platform 60 disposed within the interior cavity 30 for supporting the stacked plurality of diapers 40. Movable platform 60 is configured such that it will advance upward to keep diapers 40 pressed upward near or at the top of the housing 20. Preferably, movable platform 60 is spring loaded to apply force upward.

A diaper dispensing opening 70 in the housing 20 for dispensing a single one of the stack of diapers 40. The movable platform 60 applies force upwards to align the top diaper 90 with the dispensing opening 70. Once the top diaper 90 is removed from the device 10, the next diaper in the stack is pressed upward and aligned with the dispensing opening 70.

The device 10 preferably includes a diaper displacement mechanism 80 for advancing the single top diaper 90 at least partially outward through the dispensing opening 70, wherein the diaper displacement mechanism 80 can be selectively activated via a lever 100 by a user.

Figure 2:
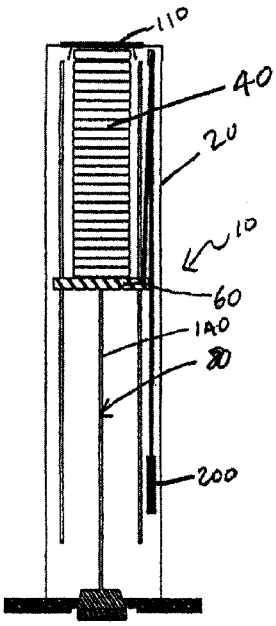
FIG. 2 is a front sectional view of one embodiment of the device of the present invention.
Figure 3:
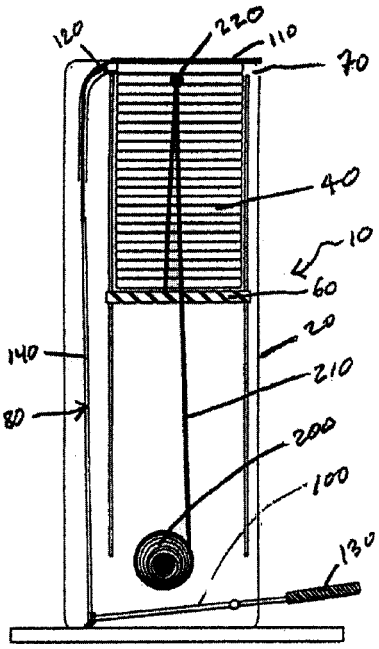
FIG. 3 is a side sectional view of one embodiment of the device of the present invention showing the device prior to dispensing a diaper.
Figure 4:
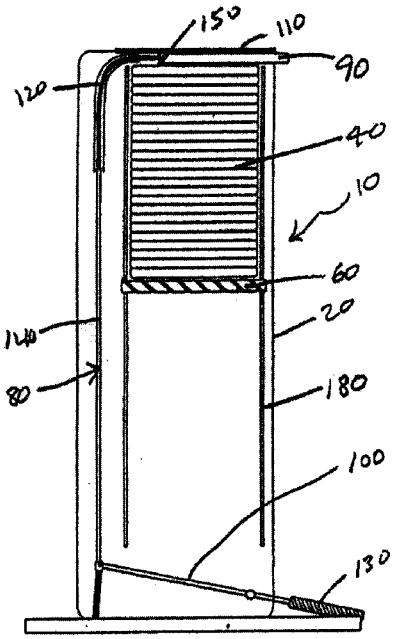
FIG. 4 is a side sectional view of one embodiment of the device of the present invention showing a diaper being dispensed.
Figure 5:
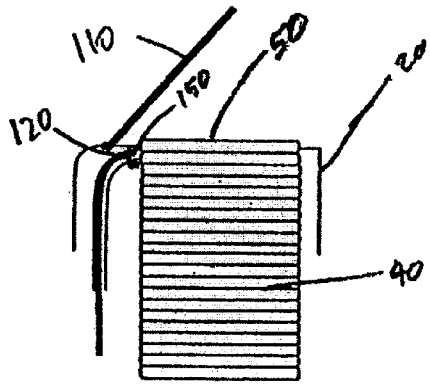
FIG. 5 is a side sectional view of one embodiment of the device of the present invention showing a top access panel opened.
Figure 6:
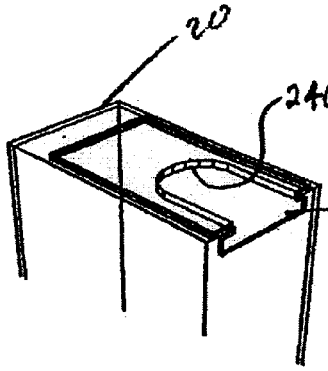
FIG. 6 is a perspective view of an embodiment of the device of the present invention showing an interior opening in the top panel.

In the diaper dispenser device 10, the access aperture 50 preferably comprises an opening 50 at a top end of the housing 20. A top panel 110 is preferably hingedly coupled to the housing 20 and adapted to cover the access aperture 50 when in a closed position, as shown in FIGS. 1–4.

In a preferred embodiment, the diaper displacement mechanism 80 comprises a plunger 120 adapted to displace the top diaper 90 by pushing it from a back side of the diaper 90. The diaper displacement mechanism 80 is operably coupled to the lever 100 such that displacement of the lever 100 by a user causes advancement of the plunger 120.

The lever 100 preferably comprises a foot pedal 130. The foot pedal 130 and lever 100 are pivotally attached with respect to the housing 20 toward a bottom end of the housing 20, wherein downward displacement of the foot pedal 130 causes upward displacement of a shaft 140 of the displacement mechanism 80. The shaft 140 is coupled to the lever 100 in such a manner that pressing the lever 100 downward such as by depressing the foot pedal 130 causes upward vertical motion of the shaft 140. The lever 100 is under tension via a spring 230 such that a force is applied to return the foot pedal 130 to an upward position when not activated. The lever 100 is further configured such that depressing the foot pedal 130 translates into sufficient motion of the plunger 120 to advance a diaper 90.

In a preferred embodiment, the shaft 140 is connected to the plunger 120, and at least a portion of the plunger 120 is flexible allowing a section of the plunger 120 to be in substantially vertical alignment with the shaft 140 and to bend into substantially horizontal alignment, wherein upward motion of the shaft 140 translates into substantially horizontal motion of an outer section of the plunger 120 to displace a diaper 90 forward through the dispensing opening 70.

The plunger preferably comprises a tip 150 shaped to interface with a single diaper 90. In one embodiment, the tip 150 has a protrusion 160 for extending underneath the top diaper 90.

The movable platform 60 is guided in a substantially vertical path of motion via guidance devices 170. The guidance devices 170 preferably comprise at least one guide rail or at least one guide rod 180. Guide rods 180 extend through guide openings 190 in the movable platform 60 in order to keep the movable platform 60 in alignment.

The movable platform 60 is preferably spring loaded to place it under a constant upward force in order to press the diapers 40 upward toward the top of the housing 20. In one embodiment, a coiled spring 200 is attached fixedly with respect to the housing 20, and a cord member 210 operates to modify a direction of force from the spring 200 via a pulley 220 which is fixedly attached to the housing 20.

In another preferred embodiment, the plunger 120 is guided by a track at the top end of the housing 20. The track may be configured within or attached to the top panel 110. In this embodiment, the dispensing opening 70 is adjacent the top panel 110. The top panel 110 preferably an interior opening 240 toward an outer edge to facilitate removal of a dispensed diaper 90.

In a further preferred embodiment, the top panel 110 comprises an interior configuration to align the top diaper 90 with the dispensing opening 70. The configuration preferably is shaped to align any of a plurality of sizes of diapers with the dispensing opening 70 so that diapers of different sizes can be loaded into the housing and maintain proper alignment. This can be accomplished, for example, by a narrowing shape as from lower portion to higher portion within the top panel 110.

The invention further encompasses a method for manufacturing a diaper storage and dispensing device 10. The method broadly encompasses providing each of the elements and features described herein. In one embodiment, the method comprises the steps of providing a housing 20 having an interior cavity 30 for storing a stacked plurality of diapers 40, providing an access aperture 50 in the housing 20 for accessing and stocking the interior cavity 30 of the housing 20 with the plurality of diapers 40, providing a substantially horizontal movable platform 60 disposed within the interior cavity 30 for supporting the stacked plurality of diapers 40, providing a diaper dispensing opening 70 in the housing 20 for dispensing a single one of the plurality of diapers 40, and providing a diaper displacement mechanism 80 for advancing the single one of the plurality of diapers 40 at least partially outward through the dispensing opening 70, wherein the diaper displacement mechanism 80 can be selectively activated via a lever 100 by a user.

While the specific embodiments have been illustrated and described, numerous modifications come to mind without significantly departing from the spirit of the invention, and the scope of protection is only limited by the scope of the accompanying claims.

What is claimed is:

1. A diaper storage and dispensing device comprising:

a housing having an interior cavity for storing a stacked plurality of diapers, an access aperture in said housing for accessing and stocking the interior cavity of said housing with the plurality of diapers, a substantially horizontal movable platform disposed within the interior cavity for supporting the stacked plurality of diapers, a diaper dispensing opening in said housing for dispensing a top one of said plurality of diapers, a diaper displacement mechanism for advancing the single one of said plurality of diapers at least partially outward through said dispensing opening, wherein said diaper displacement mechanism can be selectively activated via a lever by a user wherein said diaper dispensing mechanism comprises a plunger to displace the top one of the plurality of diapers by pushing the diaper from the back side of the diaper.

2. The diaper storage and dispensing device according to claim 1, wherein said access aperture comprises an opening at a top end of said housing, and wherein said device further comprises a top panel hingedly coupled to said housing and adapted to cover said access aperture when in a closed position.

3. The diaper storage and dispensing device according to claim 1, wherein said dispensing opening is disposed toward a top end of said housing, and wherein said movable platform is spring loaded and adapted to press the plurality of diapers upward toward the top end of said housing such that a top one of the plurality of diapers is substantially aligned with said dispensing opening.

4. The diaper storage and dispensing device according to claim 3, wherein said diaper displacement mechanism comprises a plunger adapted to displace the top one of the plurality of diapers by pushing it from a back side of the diaper, and wherein said diaper displacement mechanism is operably coupled to said lever such that displacement of said lever by a user causes advancement of said plunger.

5. The diaper storage and dispensing device according to claim 4, wherein said movable platform is configured to move a next diaper into alignment with said diaper dispensing opening upon the removal of the top diaper.

6. The diaper storage and dispensing device according to claim 3, wherein said lever comprises a foot pedal which is pivotally attached with respect to said housing toward a bottom end of said housing, and wherein downward displacement of said foot pedal causes upward displacement of a shaft of said displacement mechanism.

7. The diaper storage and dispensing device according to claim 3, wherein said movable platform is guided in a substantially vertical path of motion via guidance devices within said housing.

8. The diaper storage and dispensing device according to claim 7, wherein said guidance devices comprise guide rails.

9. The diaper storage and dispensing device according to claim 7, wherein said guidance devices comprise guide rods and wherein said guide rods extend through guide openings in said movable platform.

10. The diaper storage and dispensing device according to claim 3, wherein said movable platform is placed under tension via at least one coiled spring fixedly attached with respect to said housing and having a lead member attached to said movable platform such that said movable platform has an upward force applied thereto.

11. The diaper storage and dispensing device according to claim 10, wherein said cord member operates to modify a direction of force from said spring via a pulley which is fixedly attached to said housing.

12. The diaper storage and dispensing device according to claim 3, wherein said displacement mechanism further comprises a substantially vertical shaft coupled to said lever and configured to provide upward movement when said lever is moved in a first direction, said shaft being connected to said plunger, and wherein at least a portion of said plunger is flexible allowing a section of said plunger to be in substantially vertical alignment with said shaft and to bend into substantially horizontal alignment, wherein upward motion of said shaft translates into substantially horizontal motion of an outer section of said plunger to displace a diaper forward through said dispensing opening.

13. The diaper storage and dispensing device according to claim 12, wherein said plunger is guided by a track at the top end of said housing.

14. The diaper storage and dispensing device according to claim 13, wherein said access aperture comprises an opening at a top end of said housing, and wherein said device further comprises a top panel hingedly coupled to said housing and adapted to cover said access aperture when in a closed position, and wherein said track is attached to said top panel, said dispensing opening being disposed adjacent said top panel when said top panel is in the closed position.

15. The diaper storage and dispensing device according to claim 14, wherein said plunger comprises a tip shaped to interface with a single diaper.

16. The diaper storage and dispensing device according to claim 14, wherein said lever comprises a foot pedal, and wherein said lever is under tension via a spring such that a force is applied to return said foot pedal to an upward position when not activated, and wherein depressing said foot pedal translates into sufficient motion of said plunger to advance a diaper.

17. The diaper storage and dispensing device according to claim 14, wherein said top panel comprises an interior opening toward an outer edge to facilitate removal of a dispensed diaper.

18. The diaper storage and dispensing device according to claim 14, wherein said top panel comprises an interior configuration to align a top one of said diapers with said dispensing opening.

19. The diaper storage and dispensing device according to claim 18, wherein the interior configuration of said top panel is shaped to align any of a plurality of sizes of diapers with said dispensing opening.

20. A method for manufacturing a diaper storage and dispensing device comprising the steps of:

providing a housing having an interior cavity for storing a stacked plurality of diapers, providing an access aperture in said housing for accessing and stocking the interior cavity of said housing with the plurality of diapers, providing a substantially horizontal movable platform disposed within the interior cavity for supporting the stacked plurality of diapers, providing a diaper dispensing opening in said housing for dispensing a single one of said plurality of diapers, and providing a diaper displacement mechanism for advancing the single one of said plurality of diapers at least partially outward through said dispensing opening, wherein said diaper displacement mechanism can be selectively activated via a lever by a user wherein said diaper dispensing mechanism comprises a plunger to displace the top one of the plurality of diapers by pushing the diaper from the back side of the diaper.

* * * * *